US011286630B2

(12) United States Patent
Pan et al.

(10) Patent No.: US 11,286,630 B2
(45) Date of Patent: Mar. 29, 2022

(54) PILE FOUNDATION PERMEABLE BREAKWATER WITH VARIABLE PERMEABILITY AND CONSTRUCTION METHOD THEREOF

(71) Applicant: Ocean University of China, Qingdao (CN)

(72) Inventors: Xinying Pan, Qingdao (CN); Bingchen Liang, Qingdao (CN); Haonan Jiang, Qingdao (CN); Xiaokang Zhu, Qingdao (CN); Xunhan Xie, Qingdao (CN); Kun Wang, Qingdao (CN); Lankun Chen, Qingdao (CN)

( * ) Notice: Subject to any disclaimer, the term of this patent is extended or adjusted under 35 U.S.C. 154(b) by 0 days.

(21) Appl. No.: 16/989,840

(22) Filed: Aug. 10, 2020

(65) Prior Publication Data

US 2020/0370260 A1 Nov. 26, 2020

(30) Foreign Application Priority Data

Mar. 19, 2020 (CN) ..... 202010196988.9

(51) Int. Cl.
*E02B 3/06* (2006.01)
*E02D 5/30* (2006.01)
*E02D 27/16* (2006.01)

(52) U.S. Cl.
CPC ..... *E02B 3/06* (2013.01); *E02D 5/30* (2013.01); *E02D 27/16* (2013.01)

(58) Field of Classification Search
CPC ... E02B 3/06; E02B 3/04; E02B 3/062; E02D 5/30; E02D 27/16; Y02A 10/11
See application file for complete search history.

(56) References Cited

U.S. PATENT DOCUMENTS 4,279,536 A * 7/1981 Jarlan ..... E02B 3/14 405/21
11,072,900 B2 * 7/2021 Kettavong ..... E02B 3/06
2009/0238645 A1 * 9/2009 Aristaghes ..... E02B 3/06 405/21

(Continued)

FOREIGN PATENT DOCUMENTS

CN 206448235 * 8/2017 ..... Y02S 10/11
CN 209555866 * 10/2019 ..... Y02A 10/11
CN 211646245 * 10/2020

(Continued)

*Primary Examiner* — Carib A Oquendo

(57) ABSTRACT

The present invention discloses a pile foundation permeable breakwater with variable permeability, comprising: two rows of prefabricated pile foundations. The tops of the prefabricated pile foundations are fixedly provided with a prefabricated panel. The top of the prefabricated panel is provided with a wave wall and a breast wall. The prefabricated pile foundations are integrally connected with fixed wave breaking plates; sliding rails are installed correspondingly on the top and the bottom between every two adjacent prefabricated pile foundations in the same row; and movable wave breaking plates are slidably connected between each pair of sliding rails. A control system for controlling the slide of the movable wave breaking plates is installed on the prefabricated panel. The present invention also discloses a construction method of the pile foundation permeable breakwater with variable permeability.

10 Claims, 3 Drawing Sheets

(56) References Cited

U.S. PATENT DOCUMENTS

| | | | | |
|---|---|---|---|---|
| 2014/0270962 | A1* | 9/2014 | Andrus | E02B 3/06 405/21 |
| 2019/0010671 | A1* | 1/2019 | Villar | E02B 3/06 |

FOREIGN PATENT DOCUMENTS

| | | | | |
|---|---|---|---|---|
| CN | 211815989 | * | 10/2020 | |
| JP | 62013605 | * | 1/1987 | |
| JP | 2002180435 | * | 6/2002 | Y02A 10/11 |

* cited by examiner

PILE FOUNDATION PERMEABLE BREAKWATER WITH VARIABLE PERMEABILITY AND CONSTRUCTION METHOD THEREOF

TECHNICAL FIELD

The present invention relates to the technical, field of port and coastal engineering, and in particular to a pile foundation permeable breakwater with variable permeability and a construction method thereof.

BACKGROUND

A breakwater is a hydraulic structure needed to prevent the intrusion of waves and form a sheltered water area. The breakwater is located on the periphery of a port water area and also prevents the invasion of drifting sand and ice slush, so as to ensure sufficient water depth and smooth water surface in the port to satisfy the requirements of berthing in the port, loading and unloading operation and sailing for ships.

At present, most traditional breakwaters are impermeable sloping breakwaters or vertical breakwaters, which are limited in the circulation of water bodies in the sheltered waters, greatly change the hydrodynamic environment of the surrounding seas and are easy to cause the problems of erosion and silting changes of silt, coastline changes and water pollution in the port. Moreover, most sloping breakwaters are riprap structures, and are poor in geological conditions, scarce in stone and high in cost in some regions of China. The vertical breakwaters form a standing wave with high wave pressure due to the reflection of a straight wall, which adversely affects the water flow of the channel and the stability of the breakwaters.

Therefore, the problem to be urgently solved by those skilled in the art is how to provide a pile foundation permeable breakwater with variable permeability and a construction method thereof capable of adapting to the needs of green and environmental protection, protection of hydrodynamics, ecology and natural coastline environment.

SUMMARY

In view of this, the present invention provides a pile foundation, permeable breakwater with variable permeability, which overcomes the defects of great influence on hydrodynamic environment and ecological environment, erosion and silting changes of silt, coastline changes and water pollution in the port in the traditional breakwaters, slightly changes the original sea area environment, protects the hydrodynamic natural coastline environment, and also achieves an ideal wave breaking effect.

To achieve the above purpose, the present invention adopts the following technical solution a pile foundation permeable breakwater with variable permeability comprises: two rows of prefabricated pile foundations, wherein the tops of the two rows of prefabricated pile foundations are fixedly provided with a prefabricated panel, a wave wall is arranged on one side of a wave coming direction on the top surface of the prefabricated panel, a breast wall is arranged on the other side of the prefabricated panel arranged opposite to the wave wall; the prefabricated pile foundations are integrally connected with fixed wave breaking plates; sliding rails are installed correspondingly on the top and the bottom between every two adjacent prefabricated pile foundations in the same row; and movable wave breaking plates are slidably connected between each pair of sliding rails; and a transmission control system for controlling the slide of the movable wave breaking plates is installed on the prefabricated panel.

In the pile foundation permeable breakwater with variable permeability disclosed by the present invention, the movable wave breaking plates are added between the adjacent prefabricated pile foundations; and the transmission control system can adjust the opening degree of the movable wave breaking plates according to different wave conditions, which can achieve an ideal wave breaking effect. Meanwhile, the movement of the surrounding water flow is basically not affected, so that the seawater on both sides of the pile foundation permeable breakwater can be exchanged smoothly, so as to improve the water exchange capacity of the breakwater, slightly change the hydrodynamic environment of a surrounding sea and maximally satisfy the requirements of ecological and environmental protection.

Preferably, the prefabricated pile foundations are reinforced concrete square piles.

Preferably, pile caps are poured on the tops of the prefabricated pile foundations to protect pile heads of the prefabricated pile foundations and prevent pile bodies from inclining; the tops of the pile caps are fixedly provided with a cross beam and a longitudinal beam; and the prefabricated panel is fixedly arranged on the tops of the cross beam and the longitudinal beam to enhance structural stability.

Preferably, the cross beam, the longitudinal beam and the prefabricated panel are prefabricated assembly structures to facilitate construction.

Preferably, a baffle plate is also fixedly installed between the pile caps in the same row; and the longitudinal beam is fixedly installed on the top of the baffle plate.

Preferably, medium-coarse sand is backfilled between the wave wall and the breast wall, and a concrete surface layer is attached to enhance the structural stability.

Preferably, the width of the movable wave breaking plates is the same as the width of the fixed wave breaking plates, and is half of a distance between the adjacent prefabricated pile foundations. The transmission control system controls the opening degree of the movable wave breaking plates. The permeability of the whole pile foundation permeable breakwater is variable from 0 to 50%.

Preferably, the two rows of the movable wave breaking plates and the fixed wave breaking plates are staggered. Namely, when the movable wave breaking plates are placed in a front row, the fixed wave breaking plates are placed in opposite positions in a back row, so that the water flow can be fully turbulent in a cavity of the breakwater. In the permeable breakwater, a row facing the wave coming direction is called the front row, and a row back to the wave coming direction is called the back row. The transmission control system can adjust the opening degree of the movable wave breaking plates according to the change of the water depth and wave conditions.

Preferably, the sliding rail at the bottom is slightly higher than a lower water surface, and the sliding rail at the top is slightly lower than an upper water surface.

The present invention also discloses a construction method of the pile foundation permeable breakwater with variable permeability, comprising the following steps:

1) driving the prefabricated pile foundations into a seabed of a construction region;

2) pouring the pile caps on the top at a low water level to avoid tilting pile bodies during construction;

3) installing the top and bottom sliding rails at the low water level;

4) installing the movable wave breaking plates and the fixed wave breaking plates at the low water level;

5) installing the baffle plate between the pile caps at the low water level;

6) installing the prefabricated cross beam and the longitudinal beam on the top of the baffle plate at the low water level;

7) fixing the prefabricated panel to the cross beam and the longitudinal beam;

8) installing the transmission control system on the prefabricated panel;

9) pouring the wave wall and the breast wall;

10) backfilling the medium-coarse sand between the wave wall and the breast wall, and attaching the concrete surface layer.

It can be known from the above technical solution, that compared with, the prior art, the present invention provides a pile foundation permeable breakwater with variable permeability. The opening degree of the movable wave breaking plates can be adjusted by the transmission control system according to the change of the water depth and wave conditions. The present invention can slightly change the original, sea area environment, protect the hydrodynamic natural coastline environment, and also achieve the ideal wave breaking effect.

DESCRIPTION OF DRAWINGS

To more clearly describe the technical solution in the embodiments of the present invention or in the prior art, the drawings required to be used in the description of the embodiments or the prior art will be simply presented below Apparently, the drawings in the following description are merely the embodiments of the present invention, and for those ordinary skilled in the art, other drawings can also be obtained according to the provided drawings without contributing creative labor.

In the figures, reference signs are as follows.

1 wave wall; 2 breast wall; 3 prefabricated panel, 4 cross beam; 5 longitudinal beam; 6 pile cap; 7 prefabricated pile foundation; 8 movable wave breaking plate; 9 sliding rail; 10 baffle plate; 11 fixed wave breaking plate, 12 concrete surface layer; H depth of fixed wave breaking plate and movable wave breaking plate; h water depth.

DETAILED DESCRIPTION

The technical solution in the embodiments of the present invention will be clearly and fully described below in combination with the drawings in the embodiments of the present invention. Apparently, the described embodiments are merely part of the embodiments of the present invention, not all of the embodiments. Based on the embodiments in the present invention, all other embodiments obtained by those ordinary skilled in the art without contributing creative labor will belong to the protection scope of the present invention.

Figure 1:
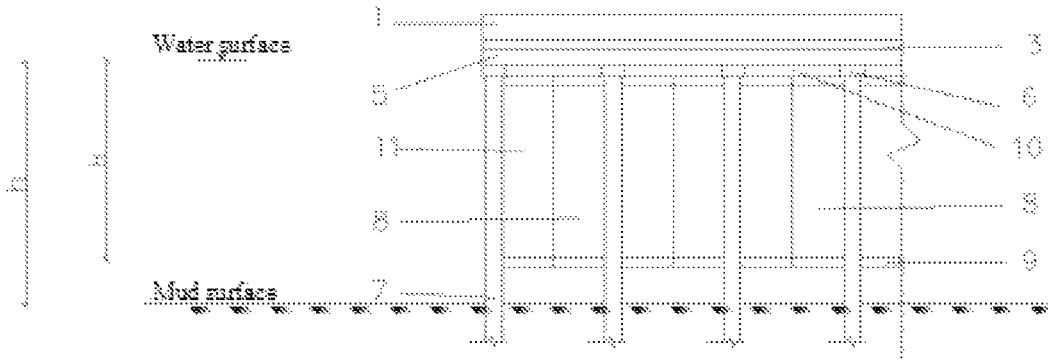
FIG. 1 is a cross sectional view provided by the present invention.
Figure 2:
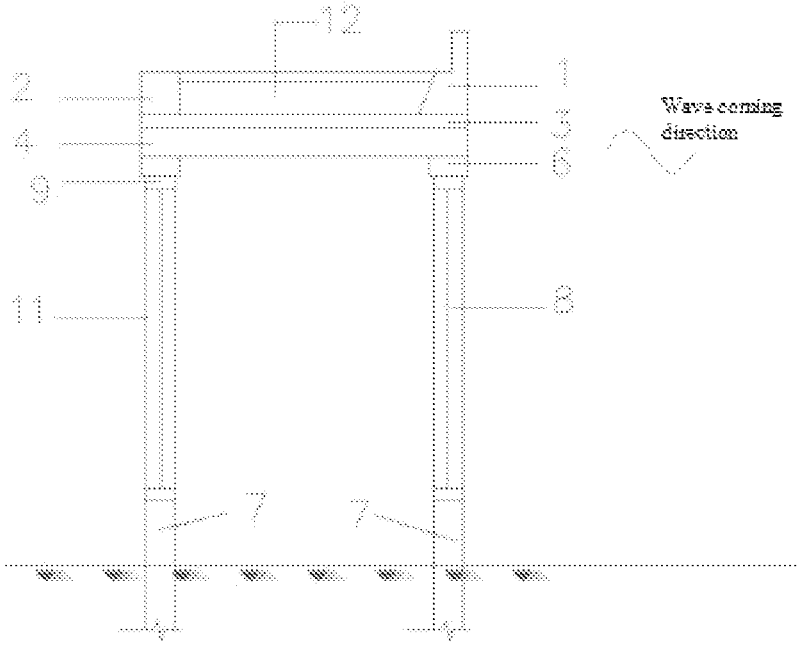
FIG. 2 is a longitudinal sectional view provided by the present invention.
Figure 3:
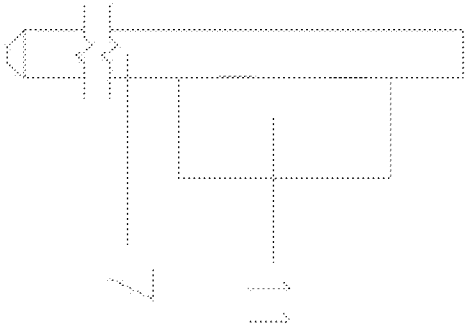
FIG. 3 is a structural diagram of a prefabricated pile foundation provided by the present invention.

As shown in FIG. 1 and FIG. 2, embodiments of the present invention disclose a pile foundation permeable breakwater with variable permeability, comprising two rows of prefabricated pile foundations 7 of prefabricated reinforced concrete square piles, pile caps 6, a cross beam 4, a longitudinal beam 5, a prefabricated panel 3, a baffle plate 10, a wave wall 1, a breast wall 2, fixed wave breaking plates 11, movable wave breaking plates 8 and a transmission control system, wherein the prefabricated pile foundations 7 are prefabricated reinforced concrete square piles with the fixed wave breaking plates 11, the pile caps 6 are poured in situ on the upper part of the square piles, and the pile caps 6 are connected in the positions of the pile heads to protect the pile heads and avoid tilting the pile bodies. The cross beam 4 and the longitudinal beam 5 are fixedly arranged on the pile caps 6; the cross beam 4 and the longitudinal beam 5 are flush with the water surface; the prefabricated panel 3 is fixedly arranged on the cross beam 4; the upper part of the longitudinal beam 5 is fixedly provided with the wave wall 1 and the breast wall 2; the wave wall 1 is arranged on one side facing the wave coming direction, and the breast wall 2 is arranged on the other side; medium-coarse sand is backfilled between the wave wall 1 and the breast wall 2, and a concrete surface layer 12 is attached. The baffle plate 10 is also fixedly installed between the pile caps 6 in the same row; and the longitudinal beam 5 is fixedly installed on the top of the baffle plate 10. Sliding rails 9 are installed between every two adjacent prefabricated pile foundations 7 in the same row; movable wave breaking plates 8 are slidably connected to the sliding rails 9; and a transmission control system for controlling the slide of the movable wave breaking plates 8 is installed on the prefabricated panel 3. The movable wave breaking plates 8 and the fixed wave breaking plates 11 are arranged at structural intervals; a front row and a back row are staggered (the front row is named as a row facing a wave coming direction, and the back row is named as a row back to the wave coming direction). Namely, when the movable wave breaking plates 8 are placed in the front row, the fixed wave breaking plates 11 are placed in opposite positions in a back row. The movable wave breaking plates 8 and the fixed wave breaking plates 11 in the front row and the back row are staggered, so that the water flow can be fully turbulent in a cavity of the breakwater.

Moreover, the structure foundations of the present embodiment are the prefabricated pile foundations 7. For the wave breaking plates, the fixed wave breaking plates 11 and the movable wave breaking plates 8 are used cooperatively. The transmission control system can adjust the opening degree of the movable wave breaking plates 8 according to different wave conditions. The movement of the surrounding water flow is basically not affected, so that the seawater on both sides of the pile foundation permeable breakwater can be exchanged smoothly, so as to improve the water exchange capacity of the permeable breakwater, slightly change the hydrodynamic environment of a surrounding sea and maximally satisfy the requirements of ecological and environmental protection.

During construction of the pile foundation permeable breakwater with variable permeability disclosed by the present embodiment, the fixed wave breaking plates 11 and the prefabricated pile foundations 7 of the reinforced concrete square piles are poured integrally. Pile bottoms of the prefabricated pile foundations 7 are fixed below a mud surface, so as to improve the capacity of eliminating waves and preventing waves and exchanging the water before and after the breakwater, and reduce the influence on the hydrodynamic environment of the sea area. The pile caps 6 are connected in the positions of the pile heads of the prefabricated pile foundations 7 to protect the pile heads and prevent pile bodies from inclining. The cross beam 4, the longitudinal beam 5 and the prefabricated panel 3 are installed above the pile caps 6 to form a beam-slab structure to support the wave wall 1 and the breast wall 2 above. The wave wall 1 is used to prevent waves from crossing the top of the breakwater. The sliding rails 9 are installed on the top and the bottom between every two adjacent prefabricated pile foundations 7 in the same row; the movable wave breaking plates 8 are slidably connected to the sliding rails 9; and the sliding rail 9 on the bottom is slightly higher than the mud surface, i.e., the lower water surface. The movable wave breaking plates 8 and the fixed wave breaking plates 11 can reflect part of wave energy, and can also realize the turbulence of the water according to spatial positions, to reduce wave height and the wave energy, so as to achieve good berthing or mooring conditions for waters in the port.

The present invention also discloses a construction method of the pile foundation permeable breakwater with variable permeability, comprising the following steps:

1) driving the prefabricated pile foundations 7 into a seabed of a construction region;

2) pouring the pile caps 6 on the top at a low water level to avoid tilting pile bodies during construction;

3) installing the top and bottom sliding rails 9 at the low water level;

4) installing the movable wave breaking plates 8 and the fixed wave breaking plates 11 at the low water level;

5) installing the baffle plate 10 between the pile caps 6 at the low water level;

6) installing the prefabricated cross beam 4 and the longitudinal beam 5 on the top of the baffle plate 10 at the low water level;

7) fixing the prefabricated panel 3 to the cross beam 4 and the longitudinal beam 5;

8) installing the control system on the prefabricated panel 3;

9) pouring the wave wall 1 and the breast wall 2;

10) backfilling the medium-coarse sand between the wave wall 1 and the breast wall 2, and attaching the concrete surface layer 12.

In the construction method of the pile foundation permeable breakwater with variable permeability disclosed by the present invention, the opening degree of the movable wave breaking plates 8 is changed by the control system; the permeability of the wave breaking plates of the breakwater is variable from 0 to 50%; the control system adjusts the opening degree of the movable wave breaking plates 8 according to the change of the water depth and wave conditions and other actual needs, so that the movement of the surrounding water flow is basically not affected. Thus, the seawater on both sides of the pile foundation permeable breakwater can be exchanged smoothly, so as to improve the water exchange capacity of the breakwater, slightly change the hydrodynamic environment of the surrounding sea and maximally satisfy the requirements of ecological and environmental protection.

Each embodiment in the description is described in a progressive way. The difference of each embodiment from each other is the focus of explanation. The same and similar parts among all of the embodiments can be referred to each other. For the device disclosed by the embodiments, because the device corresponds to a method disclosed by the embodiments, the device is simply described. Refer to the description of the method part for the related part.

The above description of the disclosed embodiments enables those skilled in the art to realize or use the present invention. Many modifications to these embodiments will be apparent to those skilled in the art. The general principle defined herein can be realized in other embodiments without departing from the spirit or scope of the present invention. Therefore, the present invention will not be limited to these embodiments shown herein, but will conform to the widest scope consistent with the principle and novel features disclosed herein.

The invention claimed is:

1. A pile foundation permeable breakwater with variable permeability, comprising: two rows of prefabricated pile foundations wherein tops of the two rows of prefabricated pile foundations are fixedly provided with a prefabricated panel; a wave wall is arranged on a top of one side of a wave coming direction on the prefabricated panel; a breast wall is arranged on the other side of the prefabricated panel arranged opposite to the wave wall; the prefabricated pile foundations are integrally connected with fixed wave breaking plates; sliding rails are installed correspondingly on the top and the bottom between every two adjacent prefabricated pile foundations in the same row; and movable wave breaking plates are slidably connected between each pair of sliding rails.

2. The pile foundation permeable breakwater with variable permeability of claim 1, wherein the prefabricated pile foundations are reinforced concrete square piles.

3. The pile foundation permeable breakwater with variable permeability of claim 2, wherein pile caps are poured on tops of the prefabricated pile foundations; tops of the pile caps are fixedly provided with a cross beam and a longitudinal beam; the prefabricated panel is fixedly arranged on the tops of the cross beam and the longitudinal beam.

4. The pile foundation permeable breakwater with variable permeability of claim 3, wherein the cross beam, the longitudinal beam and the prefabricated panel are prefabricated assembly structures.

5. The pile foundation permeable breakwater with variable permeability of claim 4, wherein a baffle plate is also fixedly installed between the pile caps in the same row; and the longitudinal beam is fixedly installed on a top of the baffle plate.

6. The pile foundation permeable breakwater with variable permeability of claim 5, wherein medium-coarse sand is backfilled between the wave wall and the breast wall; and a concrete surface layer is attached.

7. The pile foundation permeable breakwater with variable permeability of claim 6, wherein a width of the movable wave breaking plates is the same as a width of the fixed wave breaking plates, and is half of a distance between the adjacent prefabricated pile foundations.

8. The pile foundation permeable breakwater with variable permeability of claim 7, wherein two rows of the movable wave breaking plates and the fixed wave breaking plates are staggered.

9. The pile foundation permeable breakwater with variable permeability of claim 8, wherein the sliding rail at the bottom is slightly higher than a low tide water surface level, and the sliding rail at the top is slightly lower than a high tide water surface level.

10. A construction method of the pile foundation permeable breakwater with variable permeability, comprising the following steps:

1) driving prefabricated pile foundations into a seabed of a construction region;

2) pouring pile caps on a top at a low tide water level to avoid tilting pile bodies during construction;

3) installing a top and bottom sliding rails at the low tide water level;

4) installing movable wave breaking plates and fixed wave breaking plates at the low tide water level;

5) installing baffle plate between the pile caps at the low tide water level;
6) installing a prefabricated cross beam and a longitudinal beam on a top of the baffle plate at the low tide water level;
7) fixing a prefabricated panel to the prefabricated cross beam and the longitudinal beam;
8) pouring a wave wall and a breast wall;
9) backfilling medium-coarse sand between the wave wall and the breast wall; and attaching the concrete surface layer.

* * * * *